US005586366A

United States Patent [19]

Leifeld et al.

[11] Patent Number: 5,586,366

[45] Date of Patent: Dec. 24, 1996

[54] APPARATUS FOR CLEANING AND OPENING FIBER TUFTS

[75] Inventors: Ferdinand Leifeld, Kempen; Konrad Temburg, Mönchengladbach, both of Germany

[73] Assignee: Trützschler GmbH & Co. KG, Mönchengladbach, Germany

[21] Appl. No.: 539,056

[22] Filed: Oct. 4, 1995

[30] Foreign Application Priority Data

Nov. 5, 1994 [DE] Germany ..... 44 39 564.7

[51] Int. Cl.[6] ..... D01G 9/16; D01G 9/14; D01G 9/12; D01G 9/06

[52] U.S. Cl. ..... 19/105; 19/97.5; 19/204

[58] Field of Search ..... 19/97.5, 98, 105, 19/204

[56] References Cited

U.S. PATENT DOCUMENTS

| | | | |
|---|---|---|---|
| 4,926,627 | 5/1990 | Braun et al. | 19/105 X |
| 5,014,395 | 5/1991 | Staheli et al. | 19/105 |
| 5,333,358 | 8/1994 | Leifeld | 19/105 |
| 5,479,679 | 1/1996 | Leifeld | 19/105 |

FOREIGN PATENT DOCUMENTS

| | | | |
|---|---|---|---|
| 1290852 | 3/1969 | Germany . | |
| 4200394 | 9/1992 | Germany . | |
| 2240996 | 8/1991 | United Kingdom | 19/105 |
| 2274288 | 7/1994 | United Kingdom . | |

*Primary Examiner*—John J. Calvert
*Attorney, Agent, or Firm*—Spencer & Frank

[57] ABSTRACT

A fiber tuft feeding device for a fiber processing machine includes a fiber advancing member; and an extruded, light-metal feed tray defining, with the fiber advancing member, a nip between which the fiber tufts pass in a feed direction. The feed tray which has a length extending transversely to the feed direction, includes an elongated cavity extending along the tray length. An elongated element which is resistant to bending, is received in the cavity and is substantially coextensive therewith. The feeding device further includes a support for positioning the feed tray adjacent the fiber advancing member.

19 Claims, 3 Drawing Sheets

APPARATUS FOR CLEANING AND OPENING FIBER TUFTS

CROSS REFERENCE TO RELATED APPLICATION

This application claims the priority of German Application No. P 44 39 564.7 filed Nov. 5, 1994, which is incorporated herein by reference.

BACKGROUND OF THE INVENTION

This invention relates to an apparatus for cleaning and opening fiber material such as cotton, synthetic fiber or the like presented in tuft form. The apparatus includes a fiber tuft feeding device such as a feed roller cooperating with a feed tray and at least one downstream-arranged opening device such as an opening roller with a cleaning device. The fiber material passes through the feeding device and the opening device and is thereafter advanced to a fiber processing machine.

According to a prior art arrangement, the feed tray of the feeding device is movably supported for the purpose of effecting a clamping of the fiber material by the feed roller and the feed tray.

SUMMARY OF THE INVENTION

It is an object of the invention to provide an improved apparatus of the above outlined type in which the fiber material throughput is improved while maintaining a highly satisfactory clamping effect and which is simple to manufacture.

This object and others to become apparent as the specification progresses, are accomplished by the invention, according to which, briefly stated, the fiber tuft feeding device for a fiber processing machine includes a fiber advancing member; and an extruded, light-metal feed tray defining, with the fiber advancing member, a nip between which the fiber tufts pass in a feed direction. The feed tray which has a length extending transversely to the feed direction, includes an elongated cavity extending along the tray length. An elongated element which is resistant to bending, is received in the cavity and is oriented parallel to the tray length. The feeding device further includes a support for positioning the feed tray adjacent the fiber advancing member.

The use of an extruded, light-metal feed tray permits to so design the feed tray surface oriented towards the fiber material that an optimal fiber flow rate is achieved. In particular, the desired feed tray shape is obtained in a simple manner by an extrusion process. By virtue of the fact that the extruded component is associated with an element having a substantial resistance to bending, such as a steel core, flexing of the light-metal (for example, aluminum) feed tray along the machine width is prevented or at least reduced. In this manner the shape of the feed tray and thus the feed gap for the fiber material defined between the feed tray and the feed roller is configured in an optimal manner and, at the same time, the feed tray may be manufactured in a simple manner.

DESCRIPTION OF THE PREFERRED EMBODIMENTS

Figure 1:
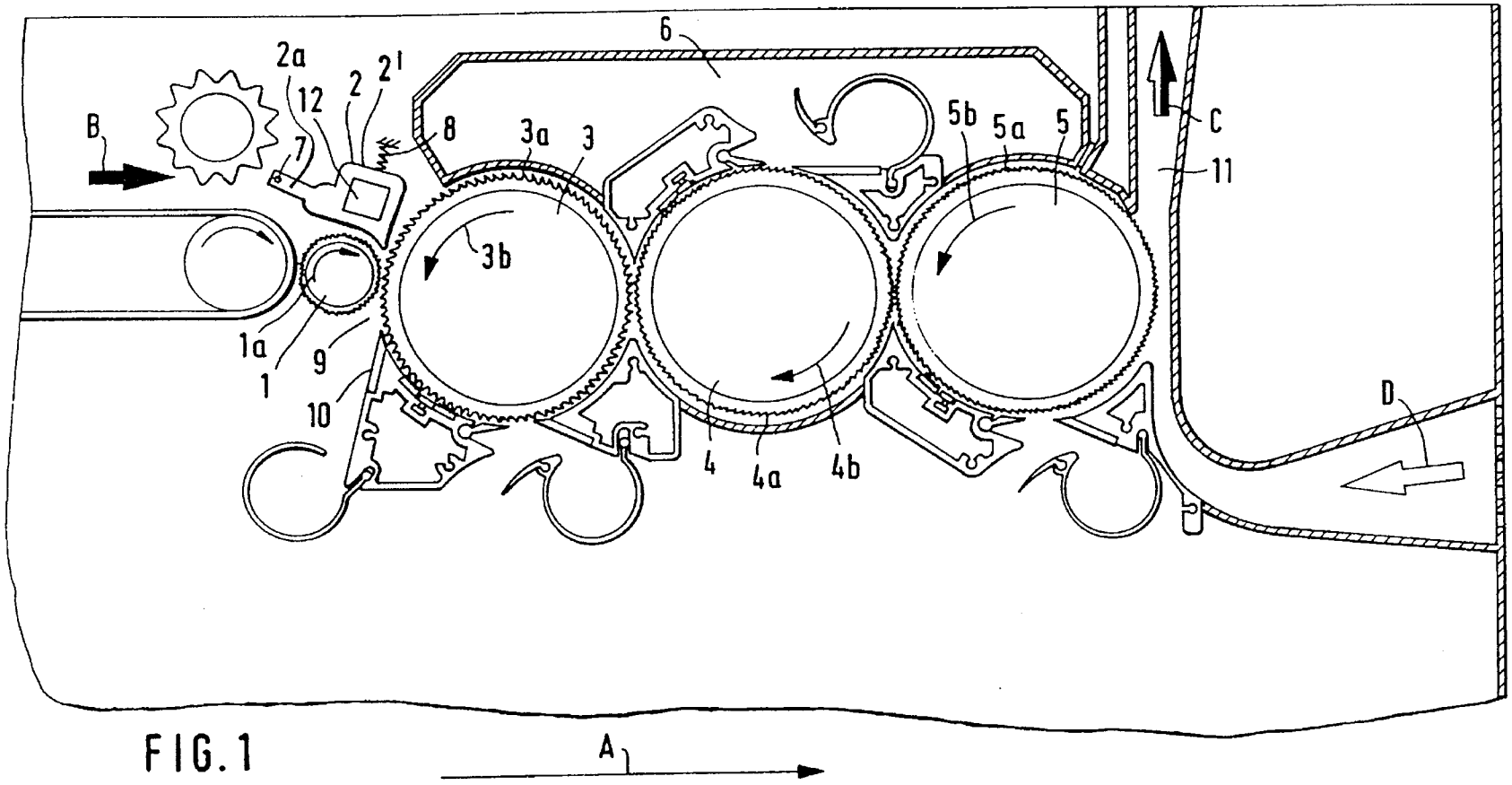
FIG. 1 is a schematic side elevational view of a three-roller fiber tuft cleaner having a resiliently supported feed tray according to the invention and a stationarily supported feed roller.

Turning to FIG. 1, there is illustrated therein a fiber tuft cleaner which may be a CVT model manufactured by Tr ützschler GmbH & Co. KG, Mönchengladbach, Germany. The apparatus is disposed in a closed housing and the fiber material B, such as cotton, is introduced in fiber tuft form into the cleaner. Such a material supply is effected by means of a non-illustrated feed chute or a conveyor belt or the like. The fiber mass is advanced to a rapidly rotating pin roller 3 by a feed roller 1 in cooperation with a feed tray 2, whereby a clamping effect is exerted on the material. The pin roll 3 may have a diameter of, for example, 250 mm and is rotatably held in the cleaner housing for a counterclockwise rotation as indicated by the arrow **3*b*. The pin roll 3 is followed by sawtooth rolls 4 and 5. The sawtooth roll 4 may have a diameter of approximately 250 mm. The pin roll 3 and the sawtooth roll 4 may have a circumferential speed of, for example, 15 m/sec and 20 m/sec, respectively. The circumferential speed of the sawtooth roll 5 is greater than that of the sawtooth roll 4. The diameter of the sawtooth roll 5 is also approximately 250 mm. The pin roll 3 is surrounded by a housing 6 and is associated with a discharge opening 9 for ejecting fiber impurities whose size is adapted to the grade of soiling of the cotton. The waste outlet opening 9** is bordered by a mote knife.

The feeding device includes the slowly rotating feed roller 1 rotating in the direction of the arrow **1*a* and the feed tray 2 situated above the feed roller 1. The feed tray 2 is supported at one end of a lateral extension 2*a* in a rotary bearing 7. The outer upper feed tray surface 2' is contacted by a compression spring 8 which resiliently loads the feed tray 2. The rotary support for the feed roller 1** is stationary.

The above described device operates as follows: the fiber lap B formed of fiber tufts is clamped by the feed roller 1 and the feed tray 2 and is advanced to the pin roll 3 which combs the fiber material and entrains, on its pins, fiber bundles from the fiber lap. As the material, carried in a circular path by the pins of the roll 3 passes by the waste discharge opening and the mote knife 10, dependent upon the circumferential speed and the curvature of the pin roll 3 as well as the size of the waste discharge opening 9, short fibers and coarse impurities are thrown out of the material by centrifugal forces. The fiber material pre-cleaned in this manner is taken over by the points **4*a* of the sawtooth roll 4 from the pin roll 3 and performs additional opening operations thereon. Thereafter the fiber material is taken over by the points 5*a* of the sawtooth roll 5 which is located immediately downstream of the roll 4, as viewed in the working direction A. The roll 5 further opens the fiber material and advances it to a pneumatic removal device 11** which transports the fiber material to a non-illustrated further fiber processing machine.

The feed tray 2 is an elongated, extruded aluminum component having a cavity which extends along the length of the feed tray, that is, along the width dimension of the cleaning apparatus and accommodates an elongated element, such as a steel bar (steel core) 12 which is resistant to bending and thus prevents undesired flexing of the feed tray along its length.

Figure 2:
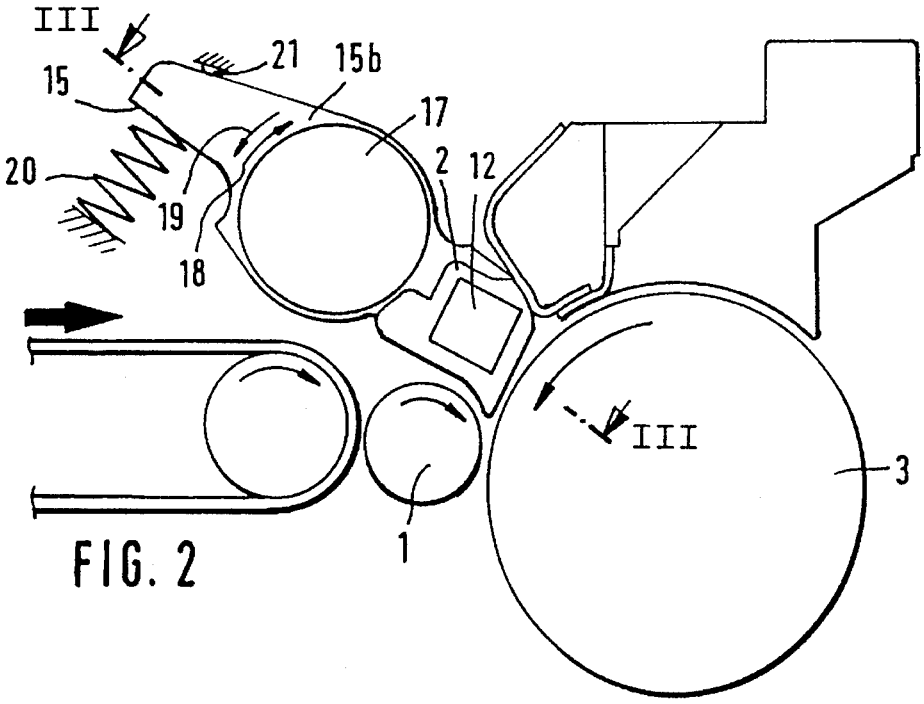
FIG. 2 is a schematic side elevational view of a preferred embodiment of the invention.
Figure 3:
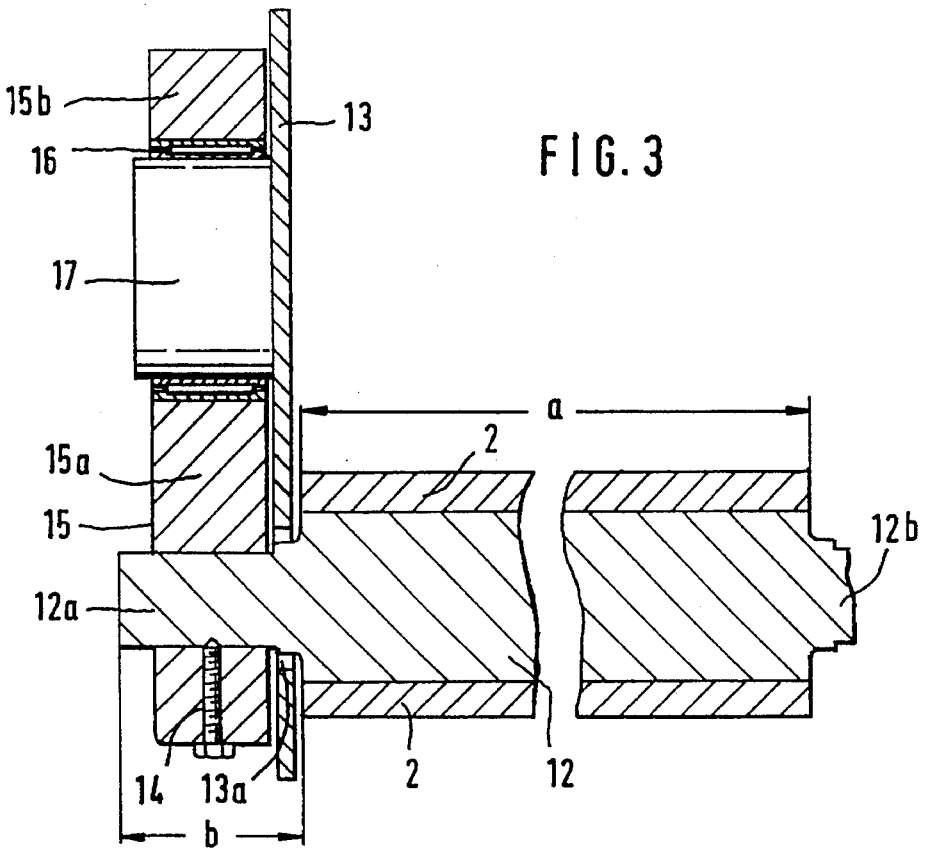
FIG. 3 is a sectional view taken along line III—III of FIG. 2.

Turning to FIGS. 2 and 3, the steel bar 12 has, at its opposite ends, stepped-down extensions 12*a*, 12*b* which have a length b and which serve for supporting the feed tray 3 in the machine frame. FIG. 3 shows such a supporting structure for the extension 12*a* which passes through an opening 13*a* in the machine stand 13. The extension 12*a* is, for example, by a screw 14, secured in a lever arm 15*a* of a holding element 15 which is pivotal in the direction 18 and 19 in a rotary bearing (such as a ball bearing) 16 about a pivot pin 17 affixed to the machine frame 13 and having a rotary axis which is perpendicular to the direction of fiber feed and parallel to the length dimension of the feed tray 2. Another lever arm 15*b* of the holding element 15 is engaged by a compression spring 20, against the force of which the feed tray 2 executes excursions in case of a thickness variation of the lap B. The machine frame 13 further carries a stop 21 which determines the minimum clearance between the feed roller 1 and the feed tray 2. As seen in FIGS. 2 and 3 when viewed together, the steel bar 12 is received in the C cavity of the feed tray 2 with a close fit. FIG. 2 further shows that the distance between the cooperating, fiber-engaging surfaces of the feed roller 1 and the feed tray 2 decreases in the direction of fiber feed.

Figure 4:
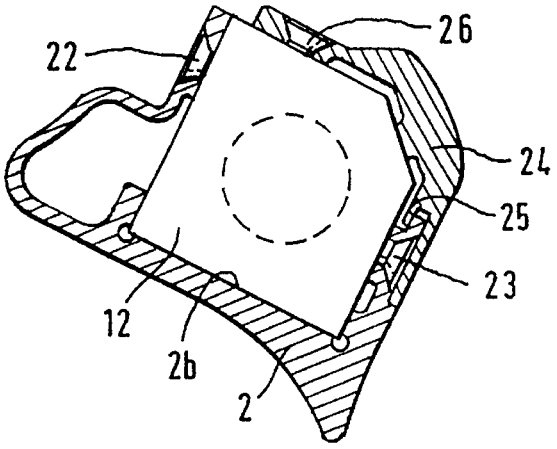
FIG. 4 is a sectional elevational view of some of the components shown in FIG. 3.

Turning to FIG. 4, the feed tray 2 has, along its length, a rectangular, laterally open cavity 2*b* receiving the steel bar (steel core) 12 of complemental rectangular cross section. Screws 22, 23 secure the steel bar 12 to the feed table 2. A closure element 24 covers the lateral opening of the feed tray 2 and is coupled thereto by a securing attachment 25. The closure element 24 is also secured to the steel core 12 by a screw 26.

Figure 5:
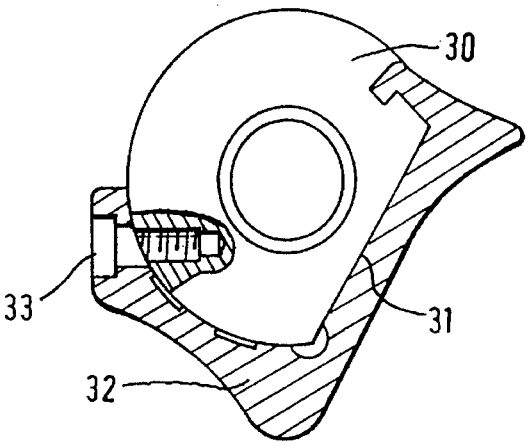
FIG. 5 is a sectional elevational view of another preferred embodiment of a component of the invention.

FIG. 5 illustrates an embodiment where the steel bar (steel core) 30 is a cross-sectionally circular component having a flattened, planar securing surface 31. The feed tray 32 has a cavity shaped complementally with the circumferential outline of the steel core 30. The steel core 30 is tightened to the feed tray 32 by a screw 33.

Figure 6:
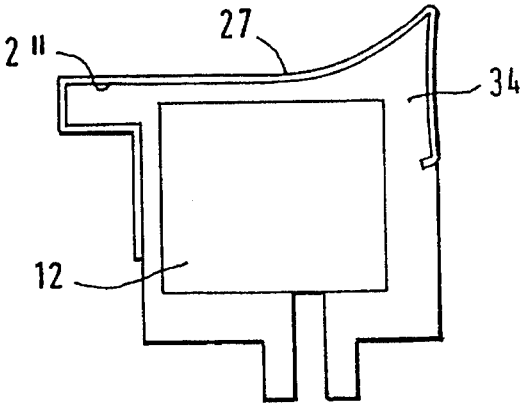
FIG. 6 is a sectional side elevational view of yet another preferred embodiment of a component of the invention.

The feed tray 34 according to the embodiment shown in FIG. 6 has a curved surface 2" which is oriented towards the fiber lap B during operation and which is provided with a wear resistant, thin sheet metal member 27 made, for example of high grade steel and is made to conform in a simple manner to the particular configuration of the surface 2" to which it may be secured by gluing. The sheet metal member 27 has smooth surfaces so that a firm connection with the feed tray surface 2" and a low-friction contact with the fiber lap B may be ensured. Instead of providing a sheet metal member, the surface 2" of the feed tray 34 may be made wear-resistant by metal plating, by providing a wear-resistant coating or by surface-hardening.

The apparatus according to the invention may find application in a machine which serves only for opening the fiber material, for example chemical fibers or which serves for both the opening and the cleaning of the fiber material, such as cotton.

It will be understood that the above description of the present invention is susceptible to various modifications, changes and adaptations, and the same are intended to be comprehended within the meaning and range of equivalents of the appended claims.

What is claimed is:

1. A fiber tuft feeding device for a fiber processing machine, comprising (a) a fiber advancing member having a first fiber-contacting surface;

(b) an extruded, light-metal feed tray having a second fiber-contacting surface defining, with said first fiber-contacting surface, a nip between which the fiber tufts pass in a feed direction; said feed tray having a length extending transversely to the feed direction; said feed tray having an elongated cavity extending parallel to said length;

(c) an elongated element received in said cavity and extending parallel to said length; said elongated element being resistant to bending; and (d) support means for positioning said feed tray adjacent said fiber advancing member.

2. The fiber tuft feeding device as defined in claim 1, wherein said fiber advancing member is a feed roller.

3. The fiber tuft feeding device as defined in claim 1, wherein said feed tray is of aluminum.

4. The fiber tuft feeding device as defined in claim 1, wherein said elongated element is a steel bar.

5. The fiber tuft feeding device as defined in claim 1, wherein said cavity of said feed tray is circumferentially closed.

6. The fiber tuft feeding device as defined in claim 1, wherein said elongated element is substantially coextensive with said length.

7. The fiber tuft feeding device as defined in claim 1, wherein said feed tray has a lateral opening; further comprising a closure member covering said opening and extending over said elongated element.

8. The fiber tuft feeding device as defined in claim 1, wherein a distance between said first and second fiber-contacting surfaces decreases in said feed direction.

9. The fiber tuft feeding device as defined in claim 1, wherein said support means comprises a rotary bearing providing for pivotal motions of said feed tray about an axis oriented perpendicularly to said feed direction and parallel to said length.

10. The fiber tuft feeding device as defined in claim 9, further comprising a force-exerting means for urging said feed tray towards said fiber advancing member.

11. The fiber tuft feeding device as defined in claim 9, wherein said support means further comprises an arm rotatably held on said rotary bearing; said arm carrying said feed tray.

12. The fiber tuft feeding device as defined in claim 11, further comprising a spring connected to said arm for urging said feed tray towards said fiber advancing member.

13. The fiber tuft feeding device as defined in claim 1, wherein said support means comprises a bearing providing for motions of said feed tray in a displacement path perpendicular to the length thereof.

14. The fiber tuft feeding device as defined in claim 13, further comprising an abutment situated in said displacement path for determining a minimum spacing between said fiber advancing member and said feed tray.

15. The fiber tuft feeding device as defined in claim 1, wherein said second fiber-contacting surface is wear-resistant.

16. The fiber tuft feeding device as defined in claim 15, further comprising a sheet metal plate at least partially covering said feed tray; said sheet metal plate having an outer face constituting said second fiber-contacting surface.

17. The fiber tuft feeding device as defined in claim 15, further comprising a metal cladding at least partially covering said feed tray; said metal cladding having an outer face constituting said second fiber-contacting surface.

18. The fiber tuft feeding device as defined in claim 15, further comprising a wear-resistant coating provided on said feed tray; said wear-resistant coating having an outer face constituting said second fiber-contacting surface.

19. The fiber tuft feeding device as defined in claim 15, wherein said second fiber-contacting surface is hardened.

* * * * *